US009167359B2

(12) United States Patent
Waldmann

(10) Patent No.: US 9,167,359 B2
(45) Date of Patent: Oct. 20, 2015

(54) HEARING SYSTEM AND METHOD FOR OPERATING A HEARING SYSTEM

(75) Inventor: Bernd Waldmann, Maur (CH)

(73) Assignee: SONOVA AG, Staefa (CH)

( * ) Notice: Subject to any disclaimer, the term of this patent is extended or adjusted under 35 U.S.C. 154(b) by 271 days.

(21) Appl. No.: 13/811,427

(22) PCT Filed: Jul. 23, 2010

(86) PCT No.: PCT/EP2010/060756
§ 371 (c)(1),
(2), (4) Date: Jan. 22, 2013

(87) PCT Pub. No.: WO2012/010218
PCT Pub. Date: Jan. 26, 2012

(65) Prior Publication Data
US 2013/0142345 A1 Jun. 6, 2013

(51) Int. Cl.
*H04R 29/00* (2006.01)
*H04R 25/00* (2006.01)

(52) U.S. Cl.
CPC ..... *H04R 25/50* (2013.01); *H04R 25/70* (2013.01); *H04R 25/552* (2013.01); *H04R 25/554* (2013.01); *H04R 25/558* (2013.01); *H04R 2225/41* (2013.01); *H04R 2225/43* (2013.01)

(58) Field of Classification Search
CPC .... H04R 25/00; H04R 25/70; H04R 2225/39; H04R 2225/61; H04R 25/75; H04R 25/552; H04R 25/554; H04R 25/558; H04R 25/50; H04R 2225/41; H04R 2225/43; H03G 3/32
USPC ..... 381/55, 56, 57, 58, 317, 66, 71.1, 71.6, 381/23.1, 312
See application file for complete search history.

(56) References Cited

U.S. PATENT DOCUMENTS 3,946,168 A 3/1976 Preves
5,473,701 A 12/1995 Cezanne et al.
(Continued)

FOREIGN PATENT DOCUMENTS

EP 1 460 769 A1 9/2004
EP 1 469 703 A2 10/2004
(Continued)

OTHER PUBLICATIONS

Telecommunication standarization sector of ITU: "ITU-T Recommendation P.563"[Online] May 31, 2884 (2884-85-31), XP882622511 Retrieved from the Internet: URL:http://www°itu °intJITU-T/index°html> [retrieved on 2811-82-14] the whole document page 8, paragraph 7°2 page 48, paragraph 9.5°3.*
(Continued)

*Primary Examiner* — Vivian Chin
*Assistant Examiner* — Ammar Hamid
(74) *Attorney, Agent, or Firm* — Pearne & Gordon LLP

(57) ABSTRACT

A hearing system (1) capable of assisting a user of the hearing system (1) to find a location where satisfactory hearing performance is achievable is described. The hearing system (1) comprises at least one hearing device (11, 12) with an input transducer (20), an output transducer (40), and a processing unit (30) operatively connected to the input transducer (20) as well as to the output transducer (40). The hearing system (1) further comprises a first means (50) for determining from a signal of the input transducer (20) at least one parameter (60) representative of a current acoustic environment at a current location, and a second means (40, 200, 201) for indicating to a user of the hearing system (1) a degree of suitability of the current location to achieve satisfactory hearing performance based on the at least one parameter (60).

18 Claims, 1 Drawing Sheet

(56) References Cited

U.S. PATENT DOCUMENTS

| | | | | |
|---|---|---|---|---|
| 6,104,822 | A | 8/2000 | Melanson et al. | |
| 7,599,507 | B2 | 10/2009 | Hansen | |
| 2007/0239294 | A1 | 10/2007 | Brueckner et al. | |
| 2010/0098262 | A1 * | 4/2010 | Frohlich | 381/60 |

FOREIGN PATENT DOCUMENTS

| | | | |
|---|---|---|---|
| EP | 1 753 264 | A1 | 2/2007 |
| WO | 02/32208 | A2 | 4/2002 |
| WO | 2004/008801 | A1 | 1/2004 |
| WO | 2005/086801 | A2 | 9/2005 |
| WO | 2007/014795 | A2 | 2/2007 |
| WO | 2009/118424 | A2 | 10/2009 |
| WO | WO 2009118424 | A2 * | 10/2009 |

OTHER PUBLICATIONS

Telecommunication Standardization Sector of ITU, ITU-T Recommendation P. 563, [Online] May 31, 2004, XP002622511, Retrieved from the INternet: URL: http://www.itu.int/ITU-T/index.html [retrieved on Feb. 14, 2011].

International Search Report for PCT/EP2010/060756 dated Mar. 16, 2011.

Written Opinion for PCT/EP2010/060756 dated Mar. 16, 2011.

* cited by examiner

HEARING SYSTEM AND METHOD FOR OPERATING A HEARING SYSTEM

TECHNICAL FIELD

The present invention is related to a hearing system comprising at least one hearing device and optionally one or more external accessories. More specifically it is related to a hearing system capable of assisting a user of the hearing system to achieve satisfactory hearing performance. Furthermore, the invention relates to a corresponding method for assisting a user of the hearing system to achieve satisfactory hearing performance.

BACKGROUND OF THE INVENTION

Communication inside a bustling restaurant or other crowded or reverberant location is one of the most difficult tasks for a hearing impaired person. The high level of background noise due to surrounding conversations reduces the signal-to-noise ratio (SNR) for the speech signal from the desired communication partner. Impulse-like noises created by cutlery clanging against plates may cause unwanted reactions in the hearing aid, such as sudden changes in amplification. Restaurants are often decorated with hard surfaces, such as glass partitions between sections of the locality, which are intended to create a sense of privacy, but which also cause highly reverberant conditions with long echo time constants both for the interfering background noise as well as for the speech signal from the desired communication partner.

In order to help improve the hearing capability of a hearing impaired person modern hearing devices provide a number of means to reduce the adverse effects encountered in difficult listening environments such as restaurants. For instance U.S. Pat. No. 3,946,168 discloses a hearing aid with a directional microphone that is capable of emphasizing the speech from the front, i.e. from the direction where the desired communication partner is usually located, thereby increasing the signal-to-noise ratio. Further, U.S. Pat. No. 5,473,701 discloses a method and apparatus for enhancing the signal-to-noise ratio of a microphone array by adjusting its directivity pattern. Alternatively, the communication partner can wear a microphone where the microphone signal is transmitted to the hearing device via a wireless link, with the intention of emphasizing the direct component of the speaker's voice, picked up close to the speaker's mouth, thereby reducing noise and reverberation. Such solutions are for instance disclosed in WO 2005/086801 A2 and EP 1 460 769 A1. As a further means, EP 1 469 703 A2 discloses a reverberation cancelling algorithm that reduces the effect of long echo time constants. Moreover, WO 2007/014795 A2 discloses a method for acoustic shock detection and its application in a system applying anti-shock gain reduction when a shock event has been indicated, for instance to reduce the unpleasant sounds produced by clashing cutlery and plates. As yet a further means, U.S. Pat. No. 6,104,822 discloses a hearing aid providing a plurality of manually selectable hearing programs adapted for a variety of listening situations. A further improvement of such a multi-program hearing device is disclosed in WO 02/32208 A2 where a method for determining an acoustic environment situation is described, which enables the automatic selection by the hearing device of a hearing program suitable for processing the audio input signal in the momentary listening situation. Alternatively, EP 1 753 264 A1 discloses a method for the determination of room acoustics, so that the signal processing in a hearing device can be automatically adapted to the current room acoustics. Moreover, U.S. Pat. No. 7,599,507 discloses a means for estimating speech intelligibility in a hearing aid in order to adjust the settings of the hearing aid. Despite the fact that the existing solutions for improving signal-to-noise ratio and reducing reverberation are effective to some extent, especially when applied in combination, the problem of reduced speech intelligibility under adverse listening conditions, such as encountered in restaurants, remains.

Within a noisy and reverberant environment such as a busy restaurant, some locations will be better suited for a hard of hearing person than others, because the level of background noise or reverberation will be lower than elsewhere. During the fitting and counselling procedure the audiologist or other hearing care specialist will often try to instruct the user of a hearing system on how to select an optimum location in a restaurant. However, such optimisation is difficult to understand and follow for someone who is not well versed in room acoustics and audiology.

SUMMARY OF THE INVENTION

It is therefore an object of the present invention to provide further means for assisting a user of a hearing system to achieve satisfactory hearing performance.

Within the present context hearing (or auditory) performance refers to an individual's ability, here specifically with the aid of a hearing device, to discern a desired sound signal, for example a speech signal originating from a communication partner, and to extract information conveyed by it within an acoustic environment typically comprising further, unwanted sound signals which are regarded as noise or interference. A person's hearing performance can for instance be expressed in terms of qualitative measures such as speech intelligibility, speech discrimination, speech recognition, speech perception, etc. and assessed in terms of quantitative measures such as the articulation index (AI), the speech intelligibility index (SII), the speech recognition threshold (SRT), etc.

At least this object is achieved by the features recited in the characterising part of claim 1. Preferred embodiments as well as a method are given in the further claims.

The present invention provides a hearing system comprising at least one hearing device with:

- an input transducer;
- an output transducer;
- a processing unit operatively connected to the input transducer as well as to the output transducer;
- a first means for determining from a signal of the input transducer at least one parameter representative of a current acoustic environment at a current location; and
- a second means for indicating to a user of the hearing system a degree of suitability of the current location to achieve satisfactory hearing performance based on the at least one parameter.

Such a hearing system according to the invention is capable of assisting a user of the hearing system to find a location where satisfactory hearing performance is achievable. By indicating to the user of the hearing system a degree of suitability of the current location to achieve satisfactory hearing performance the hearing system can help the user to avoid unsuitable locations and support the user in selecting a location where a satisfactory hearing performance is achievable with the hearing system in the current acoustic environment. Accordingly, instead of merely trying to optimise the processing of the audio input signal by the hearing system in an attempt to improve the hearing performance of the user, the hearing system additionally provides information based upon which the user can find a location where the acoustic environment is such that the user can achieve a satisfactory hearing performance with the audio signal amplification and further audio signal processing provided by the hearing system.

In one embodiment of the hearing system according to the present invention the at least one parameter representative for the current acoustic environment is one of the following:

average noise level;
reverberation time;
direct-to-reverberant ratio;
rate of acoustic shock events.

Each of these parameters can be readily determined by the hearing system and provides reliable information for assessing the suitability of the current acoustic environment to achieve satisfactory hearing performance.

In further embodiments, the hearing system according to the present invention further comprises a third means for determining from the at least one parameter a figure of merit regarding the suitability of the current location to achieve satisfactory hearing performance.

A figure of merit regarding the suitability of the current location to achieve satisfactory hearing performance takes the single parameter or brings together multiple parameters representative of the current acoustic environment at the current location and translates them into a form that can be more easily interpreted by the user in terms of the achievable hearing performance. For instance, the figure of merit can be based on an estimate of speech intelligibility. With a figure of merit that represents a direct measure of the achievable hearing performance at a certain location under the momentarily prevailing acoustic conditions the user can more readily decide whether to remain there or whether it would be better to move to another location where possibly a higher hearing performance is achievable.

In variants of the previous embodiments of the hearing system according to the invention the third means is adapted to compute the figure of merit based on at least one of the following:

a linear function of a single parameter representative for the current acoustic environment;
a linear combination of multiple parameters representative for the current acoustic environment;
a non-linear function, such as for instance a sigmoid function, of at least one parameter representative for the current acoustic environment.

Such transformations allow to appropriately account for the relevance of the individual parameters and combine them in such a way that provides the most meaningful and useful information regarding the hearing performance achievable at the present location. A weighted combination of parameters allows to deemphasize parameters providing only secondary information regarding the achievable hearing performance and to emphasize those that have a strong influence on the achievable hearing performance. Furthermore, weighting of the parameters can also be employed in order to decrease the impact of old data when assessing the achievable hearing performance at a certain location over an extended period of time whilst the acoustic environment may gradually be changing. By applying a non-linear function, such as for instance a sigmoid function, step-like function (as typically used for quantising continuous quantities) or a function with a hysteresis characteristic, to at least one parameter representative for the current acoustic environment, it is possible to provide more definite, discrete indications regarding the achievable hearing performance, e.g. a binary indication such as "satisfactory" or "non-satisfactory" instead of an indication on a continuous scale. The advantage of the former is that it is much easier for the user of the hearing system to apprehend than the latter.

In further embodiments of the hearing system according to the invention the second means is capable of providing an indication of the suitability of the current location to achieve satisfactory hearing performance in the form of an acoustic signal via the output transducer, wherein for instance the acoustic signal comprises one or a combination of the following:

one or more tones;
one or more beeps;
a jingle or melody;
a voice message.

In this way information regarding the suitability of the current location to achieve satisfactory hearing performance is provided to the user of the hearing system in an inconspicuous manner so that it can only be perceived by the user. The type of acoustic signal used to indicate the suitability of the current location to achieve satisfactory hearing performance can be selected according to the preferences of the user. The provision of certain types of acoustic signals may depend on the resources available in the at least one hearing device. Tones and beeps can be easily generated even in simple hearing devices, whereas melodies or voice messages are more complex to reproduce and may only be feasible in high-end hearing devices.

In further embodiments of the hearing system according to the invention the second means is capable of varying in dependence of the degree of suitability of the current location to achieve satisfactory hearing performance at least one of the following properties of the acoustic signal:

volume;
pitch or frequency;
modulation;
repetition rate;
composition of the jingle or melody;
content of the voice message.

In this way, a high degree of suitability of the current location to achieve satisfactory hearing performance could for instance be indicated by an acoustic signal with a high volume or a tone with a high pitch or a beep with a high repetition rate. Such a representation is especially suitable for indicating the degree of suitability on a continuous scale. Furthermore, it allows to continuously guide the user as he moves around since improvements of the suitability of the current location relative to the previous location can for instance be perceived as an increase in the volume or frequency of the acoustic signal. On the other hand different melodies, e.g. a pleasant sounding one and an awkward sounding one, respectively, could be employed to distinguish between suitable and unsuitable locations with respect to achievable hearing performance, as could be two specific voice messages such as for instance the commands "stay here" when at a suitable location, versus "move on" when located at an unsuitable location.

In further embodiments of the hearing system according to the invention indication of the suitability of the current location to achieve satisfactory hearing performance is provided to the user of the hearing system continuously or at regular intervals.

In further embodiments of the hearing system according to the invention indication of the suitability of the current location to achieve satisfactory hearing performance is provided to the user of the hearing system only if the figure of merit is above or below a certain threshold. In this way, information regarding the suitability of the current location to achieve satisfactory hearing performance is only provided to the user of the hearing system when the current position is clearly suitable, e.g. indicated by a voice message such as "stay here", or clearly unsuitable, e.g. indicated by a voice message such as "avoid this location" or "move on".

In further embodiments of the hearing system according to the invention the second means is capable of indicating a difference between the degree of suitability of the current location and that of at least a further location to achieve satisfactory hearing performance, for instance in the form of a relative difference, such as an indication of increased or decreased suitability to achieve satisfactory hearing performance.

In this way, the user can try out multiple locations in a specific locality and then request the hearing system to provide an indication of the change of suitability between two or more locations. For instance, the user can try out one location and then compare the suitability of this reference location with another location. If the other location is better suited this location is then used as the new reference location. This process can be continued until the user has determined that no new location is more suitable than the reference location, whereupon he returns to the reference location, since it is the location within the specific locality where the most satisfactory hearing performance is achievable.

In further embodiments of the hearing system according to the invention the second means is capable of adapting the indication of the degree of suitability of the current location to achieve satisfactory hearing performance based on feedback provided by the user.

In this way, the user can influence the information regarding the degree of suitability of the current location to achieve satisfactory hearing performance provided by the hearing system, thus allowing him to adjust it according to his personal perception. If for instance the hearing system is indicating to the user that hearing performance achievable at the current location is sufficient, and the user is not able to understand his communication partner sufficiently well, the user can provide feedback to the hearing system indicating, e.g. that the information provided regarding the suitability of the current location to achieve satisfactory hearing performance is too positive. Alternatively, the user could provide his personal assessment to the hearing system as feedback so that it can learn from this how the user actually perceives the situation. In this way the hearing system can gradually adapt the indication of the degree of suitability provided to the user to that which is then truly perceived by the user. Thus, the information provided to the user regarding the suitability of the current location to achieve a certain degree of hearing performance becomes more and more accurate over time. This also allows to account for a change in the user's perception as time goes by, for instance due to a progressive decrease of his hearing ability.

In further embodiments of the hearing system according to the invention the hearing system further comprises one or more external accessories, such as for instance a remote control unit, a mobile telephone or a personal digital assistant (PDA), which are operationally connectable to the at least one hearing device, wherein at least one of the following applies:

- the second means is located at the at least one hearing device;
- the second means is located at the at least one accessory or the at least one accessory comprises a further second means capable of indicating to the user of the hearing system the degree of suitability of the current location to achieve satisfactory hearing performance, wherein for instance the indication of the degree of suitability of the current location is in the form of a visual presentation on a display of the accessory or in the form of a vibration signal, for instance from a piezoelectric vibration unit at the accessory.

In this way, the information regarding the suitability of the current location to achieve a certain degree of hearing performance can for instance also be provided by an accessory such as a remote control unit, a mobile telephone or a personal digital assistant, which is separate from the at least one hearing device and can for example display the information visually, e.g. in the form of text or numbers on a screen, or a light signal generated by a multi-colour LED (light emitting diode). Such visual information can also be seen by a care-person accompanying the hearing impaired user of the hearing system, allowing the care-person to help the hearing impaired user of the hearing system, such as for instance a child, to find a location where satisfactory hearing performance can be achieved. Instead of a visual presentation a tactile presentation of the indication regarding the suitability of the current location to achieve a satisfactory hearing performance can be provided to the user in the form of a vibration signal, thus again allowing to provide the indication in an inconspicuous and convenient manner, for instance whilst the accessory is located in a pocket of the user's clothing.

In further embodiments of the hearing system according to the invention the hearing system further comprises a user control for initiating a request for information regarding the suitability of the current location to achieve satisfactory hearing performance.

In this way, the user can press a button for instance on the at least one hearing device or on an accessory whenever he would like the hearing system to provide him with information regarding the suitability of the current location to achieve satisfactory hearing performance. Thus, the user can determine when such information is desirable and avoid being disturbed by unwanted information, especially when the indication regarding the suitability of the current location to achieve satisfactory hearing performance is being provided as an acoustic signal via the transducer of the at least one hearing device.

Furthermore, the user can provide feedback to the hearing system for adapting the indication of the degree of suitability via the user control or a further one or more user controls.

In further embodiments of the hearing system at least one of the following applies:

- the user control is located at the at least one hearing device;
- the user control is located at the at least one accessory or the at least one accessory comprises a second user control for initiating a request for information regarding the suitability of the current location to achieve satisfactory hearing performance.

By providing multiple user controls at an accessory the user can more easily provide feedback to the hearing system for adapting the indication of the degree of suitability than if only a single user control is available at the at least one hearing device. A visual display such as on a screen present at an accessory further simplifies that task of providing feedback since the hearing system can thus assist the user in entering data by for instance providing appropriate requests or instructions.

Furthermore, the present invention provides a method for assisting a user of a hearing system to find a location where satisfactory hearing performance is achievable comprising the steps of:

- determining from a signal of an input transducer of the hearing system at least one parameter representative of a current acoustic environment of a current location; and indicating to the user of the hearing system the degree of suitability of the current location to achieve satisfactory hearing performance based on the at least one parameter.

In one embodiment of the method according to the present invention the at least one parameter representative for the current acoustic environment is one of the following:

average noise level;

reverberation time;

direct-to-reverberant ratio;

rate of acoustic shock events.

In further embodiments the method according to the invention further comprises determining from the at least one parameter a figure of merit regarding a suitability of the current location to achieve satisfactory hearing performance.

For instance, the figure of merit can be based on an estimate of speech intelligibility.

In further embodiments the method according to the invention the determining from the at least one parameter a figure of merit comprises one of the following:

relating the figure of merit with a single parameter representative for the current acoustic environment;

relating the figure of merit with a linear combination of multiple parameters representative for the current acoustic environment;

relating the figure of merit with a value of a non-linear function, such as for instance a sigmoid function, of at least one parameter representative for the current acoustic environment;

relating the figure of merit to an estimate of speech intelligibility.

In further embodiments the method according to the invention the indication of the suitability of the current location to achieve satisfactory hearing performance is provided in one or several of the following forms:

an acoustic signal via the output transducer of the hearing system, wherein for instance the acoustic signal comprises one or a combination of the following:

one or more tones;

one or more beeps;

a jingle or melody;

a voice message;

a visual presentation on a display;

a vibration signal.

In further embodiments the method according to the invention the indication of the degree of suitability provided to the user is an indication of a difference between the degree of suitability of the current location and that of at least a further location, for instance in the form of a relative difference, such as an indication of increased or decreased suitability.

In further embodiments the method according to the invention the indication of the degree of suitability is adapted based on feedback provided by the user.

In further embodiments the method according to the invention further comprises initiating via a user control a request for information regarding the suitability of the current location to achieve satisfactory hearing performance It is expressly pointed out that any combination of the above-mentioned embodiments, or combinations of combinations, is subject of a further combination. Only those combinations are excluded that would result in a contradiction.

BRIEF DESCRIPTION OF THE DRAWINGS

For the purpose of facilitating the understanding of the present invention, exemplary embodiments thereof are illustrated in the accompanying drawings which are to be considered in connection with the following description. Thus, the present invention may be more readily appreciated.

DETAILED DESCRIPTION OF THE INVENTION

Figure 1:
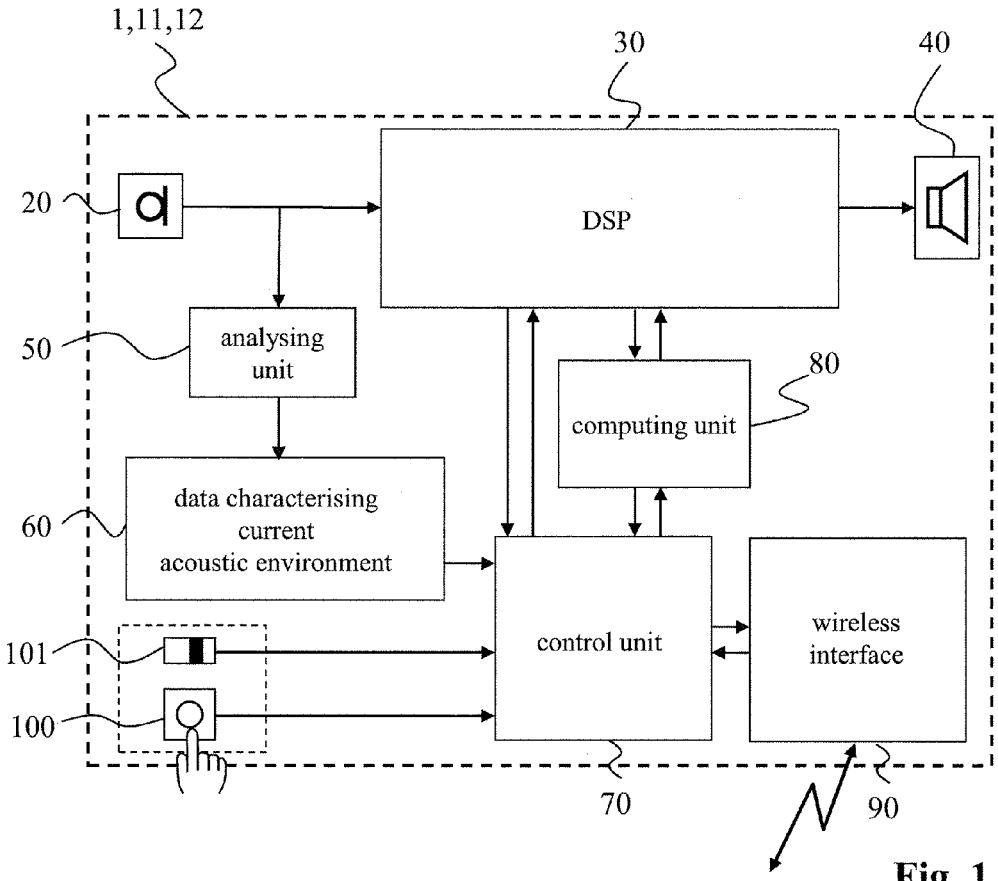
FIG. 1 shows a block diagram of a hearing system according to the present invention.

FIG. 1 depicts a block diagram of a hearing device 11, 12 of the hearing system according to the invention. The hearing device 11, 12 picks up the ambient sound by an input transducer in the form of a microphone 20 that produces an electrical signal, i.e. the audio input signal, which is processed (after analogue-to-digital conversion; not shown) by a digital signal processor (DSP) 30, the output of which is then applied (after digital-to-analogue conversion; not shown) to an output transducer in the form of a miniature speaker also referred to as a receiver 40. The sound from the receiver is subsequently supplied to an ear drum of the user. Other input and output transducers can be employed, especially in conjunction with implantable hearing devices such as bone anchored hearing aids (BAHAs), middle ear or cochlear implants.

In order to assist the user of the hearing device 11, 12 to find a location where satisfactory hearing performance can be achieved, the signal from the microphone 20 is provided to an analysing unit 50 which determines at least one parameter 60 representative of a current acoustic environment at the current location. The parameter 60 determined by the analysing unit 50 can for instance be an average noise level, a reverberation time (e.g. the time required for the sound level produced by a source to decrease by a certain amount after the source stops generating the sound), a direct-to-reverberant ratio (e.g. the ratio of the energy in the first sound wave front to the reflected sound energy) or the rate of acoustic shock events (e.g. sound impulses whose amplitude changes within a very short time duration to a high energy level such as caused by a slamming door, or glasses or pieces of cutlery hitting against one another).

In case this data 60 is not a direct measure of the degree of suitability of the current location to achieve satisfactory hearing performance or if for instance the user desires another, more easily interpretable measure, the data 60 characterising the current acoustic environment is converted into a figure of merit regarding the suitability of the current location to achieve satisfactory hearing performance by the computing unit 80. For instance, the computation of the figure of merit could be based on the following parameters: the measured noise level, i.e. data 60 characterizing the current acoustic environment, the expected speech level of a normal hearing person as perceived at a distance of 1 m being a typical spacing between two communication partners, i.e. data characteristic for the hearing situation such as a conversation in a restaurant, and the sound pressure level required to achieve 50% speech recognition (=speech recognition threshold, SRT) for the particular user of the hearing system, i.e. data depending on his hearing ability when supported by the hearing system. The SRT may have been determined from the hearing threshold of this user using well known data from the literature (see e.g. R. Plomp, "A signal-to-noise ratio model for the speech-reception threshold of the hearing impaired," J. Speech Hearing Res. 29 (1986), pp. 146-154), or it may have been measured by a hearing health care professional. The expected signal-to-noise ratio (SNR) is then determined as the ratio of the expected speech level to the measured noise level, which is then used together with the SRT to predict the level of speech recognition for the particular user of the hearing system. Then for instance, a sigmoid function whose characteristic is chosen such that the function approaches a maximum value when the expected SNR is more than 6 dB above the user's SRT and the function approaches a minimum when the expected SNR is more than 6 dB below the user's SRT, can be applied to the predicted level of speech recognition. In this way the resulting figure of merit substantially discriminates between two situations namely those in which speech will be poorly recognised, i.e. hearing performance is insufficient, because the SNR is too low and those in which speech will be well recognised, i.e. hearing performance is sufficient. Between these two distinct situations, where speech recognition is either possible or not, lies a transitional region where the speech recognition is marginal, very likely making speech communication difficult. Based on such a figure of merit the user of the hearing system 1 can more definitely identify locations where satisfactory hearing performance is achievable, than with a figure of merit based on a linear scale that gradually progresses from a value indicating low achievable hearing performance to a value indicating high achievable hearing performance. The transitional region in the above mentioned figure of merit function can however help to guide the user of the hearing system towards a location where sufficient hearing performance is achievable since the gradient characteristic of the transitional region can be used to identify an improvement or degradation of the achievable hearing performance when changing locations.

Figure 2:
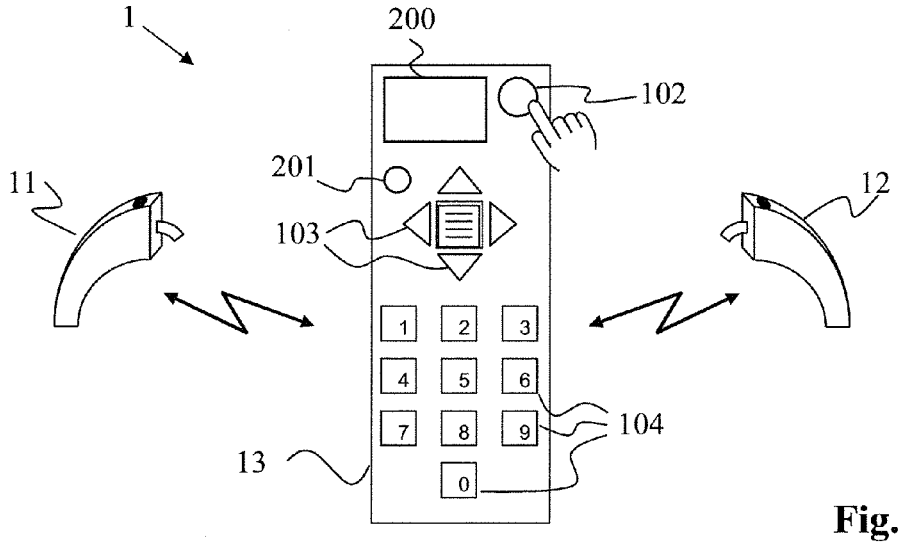
FIG. 2 shows a schematic representation of a hearing system according to present the invention.

The figure of merit or alternatively a parameter representative of the current acoustic environment at a current location is then applied to an appropriate means which is capable of providing an indication of the suitability of the current location to achieve satisfactory hearing performance. This means can for instance be the receiver 40 generating one or more tones or beeps or a melody or voice message as a function of the figure of merit or the parameter. The dependency on the figure of merit or the parameter, i.e. the degree of suitability of the current location to achieve satisfactory hearing performance, can be indicated to the user for instance by changing the volume or frequency of the tone, or the repetition rate of the beeps, or the kind of melody or voice message generated accordingly. If the hearing device 11, 12 features a wireless interface 90 the figure of merit or parameter can additionally or alternatively be transmitted to a separate accessory such as a remote control unit 13, as shown in FIG. 2, equipped with a screen 201 or other form of display or optical indicator such as an LED (light emitting diode) 202, preferably a multicolour LED for generating a multitude of different optical signals. The figure of merit or parameter can then be displayed on the screen 201 of the remote control unit 13 or with the aid of the LED 202 located at the remote control unit 13.

The user of the hearing system 1 can initiate a request for information regarding, i.e. an indication of the suitability of the current location to achieve a satisfactory hearing performance by operating a user control 100 such as press button or toggle switch at the hearing device 100. Alternatively, a corresponding user control 102 can be provided at the remote control unit 13. Moreover, further user controls 101, 103, 104 can be provided at the hearing device 11, 12 and/or at the remote control unit 13 in order to allow the user of the hearing system 1 to provide feedback regarding the suitability of the current location to achieve satisfactory hearing performance. With the aid of the numeric keypad 104 and/or the arrow keys 103 the user can provide information to the hearing system 1 for instance regarding how he perceives the degree of suitability of the current location to achieve satisfactory hearing performance. Based on this feedback the hearing system 1 can adapt its indication of the degree of suitability of the current location to achieve satisfactory hearing performance. For instance, if the hearing system 1 is indicating to the user that the current location is suited to achieve satisfactory hearing performance whilst the user is unable to understand what his communication partner is saying, the user can provide feedback to the hearing system 1, for example in the form of a rating, e.g. from 0 to 9, input via the keypad, or in relative terms, e.g. "indication too high/low", input via the arrow keys (up/down). The hearing system 1 can then learn from this feedback how the user perceives the actual situation at the current location and is able to adapt its future indication of the degree of suitability of the current location to achieve satisfactory hearing performance accordingly.

Once the user of the hearing system has arrived at a location where he is achieving satisfactory hearing performance, he may want to save relevant information thereto, such as the exact position of the location as well as a measure of the degree of suitability of that location to achieve satisfactory hearing performance, for future use, e.g. by himself or by someone else seeking a location where satisfactory hearing performance is achievable. The exact position can for instance be determined by an appropriate positioning device such as a GPS (Global Positioning System) module within a mobile phone, e.g. operating as part of the hearing system. Exact positioning is even possible indoors by using so-called "local positioning technologies" based on evaluating radio frequency (RF) signals originating from cellular base stations, Wi-Fi access points, broadcasting towers, etc. The position information is then sent together with information regarding the degree of suitability of that location to achieve satisfactory hearing performance by the mobile phone for example to a central database from which it can be retrieved by users in search of a location providing satisfactory hearing performance in a specific area. The position information may then be employed by a navigation system, which could again be part of a mobile phone, to guide such a user to a suitable hearing location. In this way even users of a conventional hearing system without the advanced capability of a hearing system according to present invention can profit from the location information along with information regarding the degree of suitability of that location to achieve satisfactory hearing performance provided by users of a hearing system according to the invention.

LIST OF REFERENCE SYMBOLS

1 Hearing system
11, 12 Hearing device
13 Remote control (external accessory)
20 Microphone
30 DSP (digital signal processor)
40 Receiver (miniature speaker)
50 Analysing unit (=first means)
60 Data characterising current acoustic environment
70 Control unit
80 Computing unit for computing a figure of merit
90 Wireless interface
100, 102 User control
101 Further user control
103 Arrow keys & selection button (further user controls)
104 Numeric keypad (further user controls)
200 Screen/display
201 LED (light emitting diode)

The invention claimed is:

1. A hearing system comprising at least one hearing device having:

an input transducer;

an output transducer; and a processing unit operatively connected to the input transducer as well as to the output transducer;

and the hearing system further comprising:

an analyzing unit for determining from a signal of the input transducer at least one parameter representative of a current acoustic environment at a current location; and a an output transducer and/or display for indicating to a user of the hearing system a degree of suitability of the current location to achieve satisfactory hearing performance based on the at least one parameter, wherein the output transducer and/or display is configured for indicating a difference between the degree of suitability of the current location and a degree of suitability of at least one further location to achieve satisfactory hearing performance, wherein the at least one parameter representative of the current acoustic environment is one of the following:

average noise level;

reverberation time; -direct-to-reverberant ratio; and rate of acoustic shock events.

2. The hearing system of claim 1, further comprising a computing unit for determining from the at least one parameter a figure of merit regarding the suitability of the current location to achieve satisfactory hearing performance.

3. The hearing system of claim 2, wherein the third means is adapted to compute the figure of merit based on at least one of the following:

a linear function of one of the at least one parameter representative of the current acoustic environment;

a linear combination of multiple parameters of the at least one parameter representative of the current acoustic environment; and a non-linear function of the at least one parameter representative of the current acoustic environment.

4. The hearing system of claim 1, wherein the output transducer and/or display is capable of providing an indication of the suitability of the current location to achieve satisfactory hearing performance in the form of an acoustic signal via the output transducer, wherein the acoustic signal comprises one or a combination of the following:

one or more tones;

one or more beeps;

a jingle or melody; and a voice message.

5. The hearing system of claim 1, wherein the output transducer and/or display is capable of varying in dependence of the degree of suitability of the current location to achieve satisfactory hearing performance at least one of the following properties of the acoustic signal:

volume;

pitch or frequency;

modulation;

repetition rate;

composition of the jingle or melody; and content of the voice message.

6. The hearing system of claim 1, wherein the output transducer and/or display is capable of adapting the indication of the degree of suitability of the current location to achieve satisfactory hearing performance based on feedback provided by the user.

7. The hearing system of claim 1, further comprising at least one external accessory, which are operationally connectable to the at least one hearing device, wherein at least one of the following applies:

the output transducer and/or display is located at the at least one hearing device;

the output transducer and/or display is located at the at least one accessory or the at least one accessory comprises a further output transducer and/or display capable of indicating to the user of the hearing system the degree of suitability of the current location to achieve satisfactory hearing performance.

8. The hearing system of claim 1, further comprising a user control for initiating a request for information regarding the suitability of the current location to achieve satisfactory hearing performance.

9. The hearing system of claim 8, wherein at least one of the following applies:

the user control is located at the at least one hearing device;

the user control is located at the at least one accessory or the at least one accessory comprises a second user control for initiating a request for information regarding the suitability of the current location to achieve satisfactory hearing performance.

10. A method for assisting a user of a hearing system to find a location where satisfactory hearing performance is achievable comprising steps of:

determining by an analyzing unit from a signal of an input transducer of the hearing system at least one parameter representative of a current acoustic environment of a current location; and indicating by an output transducer and/or display to the user of the hearing system a degree of suitability of the current location to achieve satisfactory hearing performance based on said at least one parameter, wherein the indication of the degree of suitability provided to the user is an indication of a difference between the degree of suitability of the current location and a degree of suitability of at least one further location, wherein the at least one parameter representative of the current acoustic environment is one of the following:

average noise level;

reverberation time;—direct-to-reverberant ratio; and rate of acoustic shock events.

11. The method of claim 10, further comprising a step of determining from the at least one parameter a figure of merit regarding a suitability of the current location to achieve satisfactory hearing performance.

12. The method of claim 11, wherein the step of determining a figure of merit comprises one of the following:

relating the figure of merit to a single parameter of the at least one parameter representative of the current acoustic environment;

relating the figure of merit to a linear combination of multiple parameters of the at least one parameter representative of the current acoustic environment;

relating the figure of merit to a value of a non-linear function of the at least one parameter representative of the current acoustic environment; or relating the figure of merit to an estimate of speech intelligibility.

13. The method of claim 10, wherein the indication of the suitability of the current location to achieve satisfactory hearing performance is provided in one or several of the following forms:

an acoustic signal via the output transducer of the hearing system;

a visual presentation on a display; and a vibration signal.

14. The method according to claim 10, wherein the indication of the degree of suitability is adapted based on feedback provided by the user.

15. The method according to claim 10, further comprising a step of initiating via a user control a request for information regarding the suitability of the current location to achieve satisfactory hearing performance.

16. The hearing system of claim 7, further comprising a user control for initiating a request for information regarding the suitability of the current location to achieve satisfactory hearing performance.

17. The method of claim 13, wherein the acoustic signal comprises one or a combination of the following:

one or more tones;

one or more beeps;

a jingle or melody; and a voice message.

18. The hearing system according to claim 7, in which the indication of the degree of suitability of the current location is in the form of a visual presentation on a display of the accessory or in the form of a vibration signal from a piezoelectric vibration unit at the accessory.

* * * * *